US010126773B2

(12) United States Patent
Hofer et al.

(10) Patent No.: US 10,126,773 B2
(45) Date of Patent: Nov. 13, 2018

(54) CIRCUIT AND METHOD FOR PROVIDING A SECONDARY REFERENCE VOLTAGE FROM AN INITIAL REFERENCE VOLTAGE

(71) Applicant: Infineon Technologies AG, Neubiberg (DE)

(72) Inventors: Maximilian Hofer, Hartberg (AT); Albert Missoni, Graz (AT)

(73) Assignee: Infineon Technologies AG, Neubiberg (DE)

( * ) Notice: Subject to any disclaimer, the term of this patent is extended or adjusted under 35 U.S.C. 154(b) by 891 days.

(21) Appl. No.: 14/260,302

(22) Filed: Apr. 24, 2014

(65) Prior Publication Data

US 2015/0309523 A1 Oct. 29, 2015

(51) Int. Cl.
*G05F 3/20* (2006.01)
*G05F 3/02* (2006.01)
*G05F 3/30* (2006.01)

(52) U.S. Cl.
CPC . *G05F 3/02* (2013.01); *G05F 3/30* (2013.01)

(58) Field of Classification Search
CPC . G05F 3/30; G05F 3/222; G05F 3/225; G05F 3/242; G05F 3/245
USPC ..... 323/314, 331
See application file for complete search history.

(56) References Cited

U.S. PATENT DOCUMENTS

2004/0046538 A1 3/2004 Sivero et al.
2004/0155636 A1* 8/2004 Fukui ..... G05F 1/56 323/281
2005/0018458 A1* 1/2005 Shimada ..... H02M 1/4225 363/125
2005/0184797 A1* 8/2005 Choi ..... G05F 3/247 327/541
2006/0038609 A1 2/2006 Oddone et al.
2008/0186003 A1 8/2008 Cho et al.
2009/0058512 A1* 3/2009 Huang ..... G05F 3/30 327/539
2009/0251961 A1* 10/2009 Nam ..... G11C 5/145 365/185.2
2010/0164465 A1* 7/2010 Yang ..... G05F 3/30 323/313
2014/0028409 A1* 1/2014 Mahooti ..... G05F 3/30 331/146

FOREIGN PATENT DOCUMENTS

DE 102005045695 A1 4/2006
DE 102007050361 A1 5/2008
DE 102012007899 A1 10/2013

* cited by examiner

*Primary Examiner* — Adolf Berhane
*Assistant Examiner* — Afework Demisse
(74) *Attorney, Agent, or Firm* — Viering, Jentschura & Partner mbB

(57) ABSTRACT

According one embodiment, a circuit is described comprising a first reference voltage generating circuit comprising an output to provide a first reference voltage and a second reference voltage generating circuit comprising an input receiving a value representative of the first reference voltage, the second reference voltage generating circuit being configured to generate a second reference voltage based on the received value.

13 Claims, 8 Drawing Sheets

CIRCUIT AND METHOD FOR PROVIDING A SECONDARY REFERENCE VOLTAGE FROM AN INITIAL REFERENCE VOLTAGE

TECHNICAL FIELD

Various embodiments relate generally to circuits and methods for providing a reference voltage.

BACKGROUND

Many circuits require a reference voltage for operation. While these may be provided with high accuracy, e.g. using a bandgap voltage reference, the current consumption of the reference voltage generator may be an issue in addition to the accuracy of the reference voltage. Accordingly, approaches to provide a reference voltage with high accuracy and low power consumption are desirable.

SUMMARY

According one embodiment, a circuit is provided comprising a first reference voltage generating circuit comprising an output to provide a first reference voltage and a second reference voltage generating circuit comprising an input receiving a value representative of the first reference voltage, the second reference voltage generating circuit being configured to generate a second reference voltage based on the received value.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Reference voltage generation is a general topic in CMOS (complementary metal oxide semiconductor) analog circuit design. There are a lot of approaches to realize it in silicon. One typical approach is to use a bandgap voltage reference (BGP), where a bipolar transistor or diode is used. A BGP is a cheap way to produce a very accurate voltage reference. However, such a voltage reference needs a certain minimum amount of energy to operate. This required energy may be too high for some applications where current consumption is crucial.

Various approaches may be used to minimize the average current consumption of a reference voltage generator. One is to use voltage references of different accuracies at different points in time. For example, a BGP may be used when accuracy is important and current consumption is not critical. A CMOS voltage generator may be used when accuracy is not important and the current required by the reference voltage generator has to be very low.

According to one embodiment, the issue of energy consumption of a reference voltage generator being too high is addressed by combining a BPG with a digital controlled low power voltage buffer.

Figure 1:
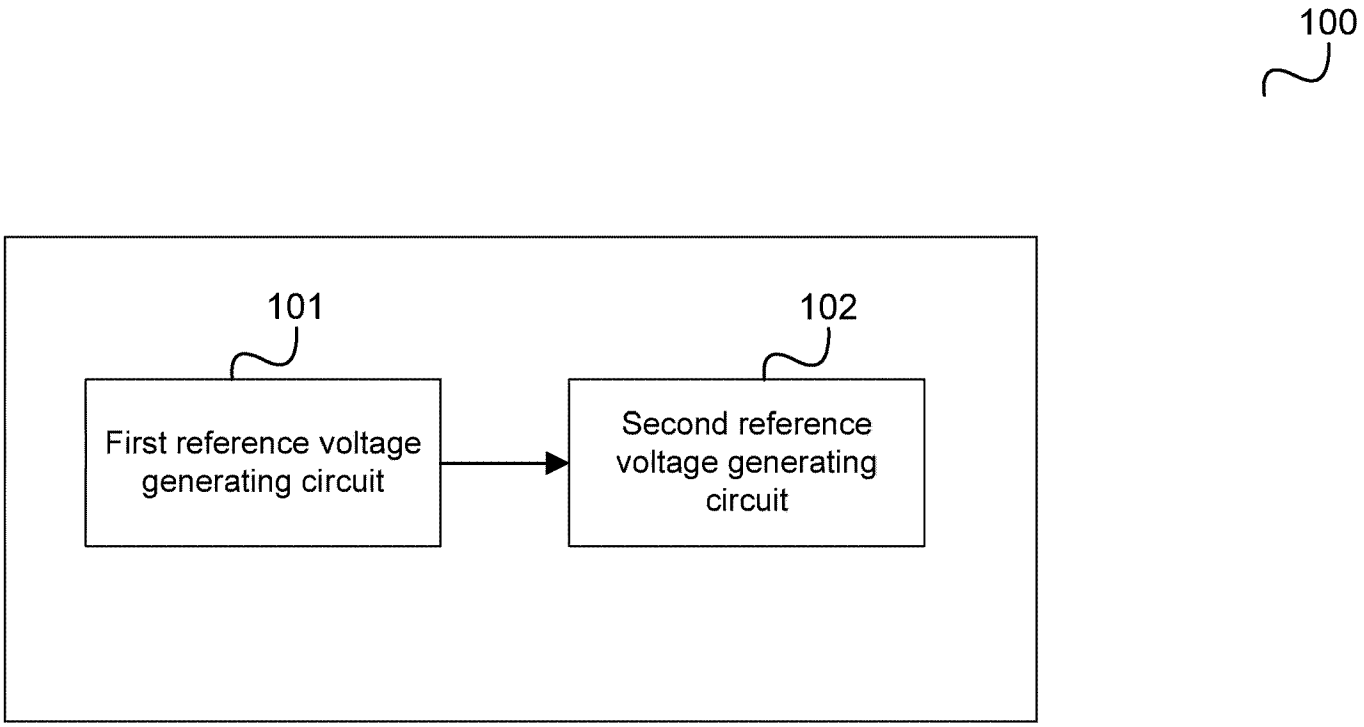
FIG. 1 shows a circuit according to an embodiment.

Generally, according to one embodiment, a circuit is provided as illustrated in FIG. 1.

FIG. 1 shows a circuit 100 according to an embodiment.

The circuit 100 comprises a first reference voltage generating circuit 101 comprising an output to provide a first reference voltage.

The circuit 100 further comprises a second reference voltage generating circuit 102 comprising an input receiving a value representative of the first reference voltage, the second reference voltage generating circuit 102 being configured to generate a second reference voltage based on the received value.

According to one embodiment, in other words, two reference voltage generating circuits are used in combination, or, in other words, in series, wherein the second reference voltage generating circuit is controlled based on the voltage reference of the first reference voltage generating circuit. In other words, the second reference voltage generating circuit receives information based on the voltage reference of the first reference voltage generating circuit and provides a reference voltage based on the received information.

The second reference voltage generating circuit may for example store the value representative of the first reference voltage of the first reference voltage such that it may still provide the second reference voltage when the first reference voltage generating circuit is switched off, i.e. does not provide a voltage reference.

For example, the first reference voltage generating circuit is a BGP voltage generating circuit. When there is enough current available in the circuit, a value representative of the first reference voltage is stored (e.g. analog information of the bandgap is stored in an analog voltage buffer or a digital value representative of the first reference voltage is stored in a register) which can be used by the second reference voltage generating circuit when the BGP voltage generating circuit is down, i.e. switched off, e.g. to reduce the current required by the circuit.

According to one embodiment, the circuit further comprises an error determination circuit configured to provide an error signal based on the first reference voltage and the second reference voltage, wherein the second reference voltage generating circuit is configured to provide the second reference voltage based on the error signal.

The circuit may for example comprise a controlling circuit configured to determine the value representative of the first reference voltage based on the error signal.

The first reference voltage generating circuit for example generates the first reference voltage with a higher accuracy than the accuracy with which the second reference voltage generating circuit generates the second reference voltage.

For example, the first reference voltage generating circuit is a bandgap voltage reference generator.

According to one embodiment, the second reference voltage generating circuit is configured to generate the second reference voltage in a state of the circuit when the first reference voltage generating circuit is switched off. This state is for example a state of reduced current consumption, e.g. a power saving state.

The second reference voltage generating circuit may comprise a memory configured to store the value representative of the first reference voltage or a value depending from the value representative of the first reference voltage. The value depending from the value representative of the first reference voltage may also depend from other values such as mismatches and other error sources. It may for example represent the difference between the first reference voltage and the second reference voltage.

The value representative of the first reference voltage is for example a control value for the second reference voltage generating circuit for controlling the second reference voltage generating circuit to output a reference voltage with a predetermined relation to the first reference voltage.

According to one embodiment, the value representative of the first reference voltage or the value depending from the value representative of the first reference voltage is a digital value. For example, the value representative of the first reference value (or the or a value derived from the value representative of the first reference voltage) is a difference between the second reference voltage and the first reference voltage and this value is represented as a digital value.

The second reference voltage generating circuit is for example a CMOS voltage generator.

Figure 2:
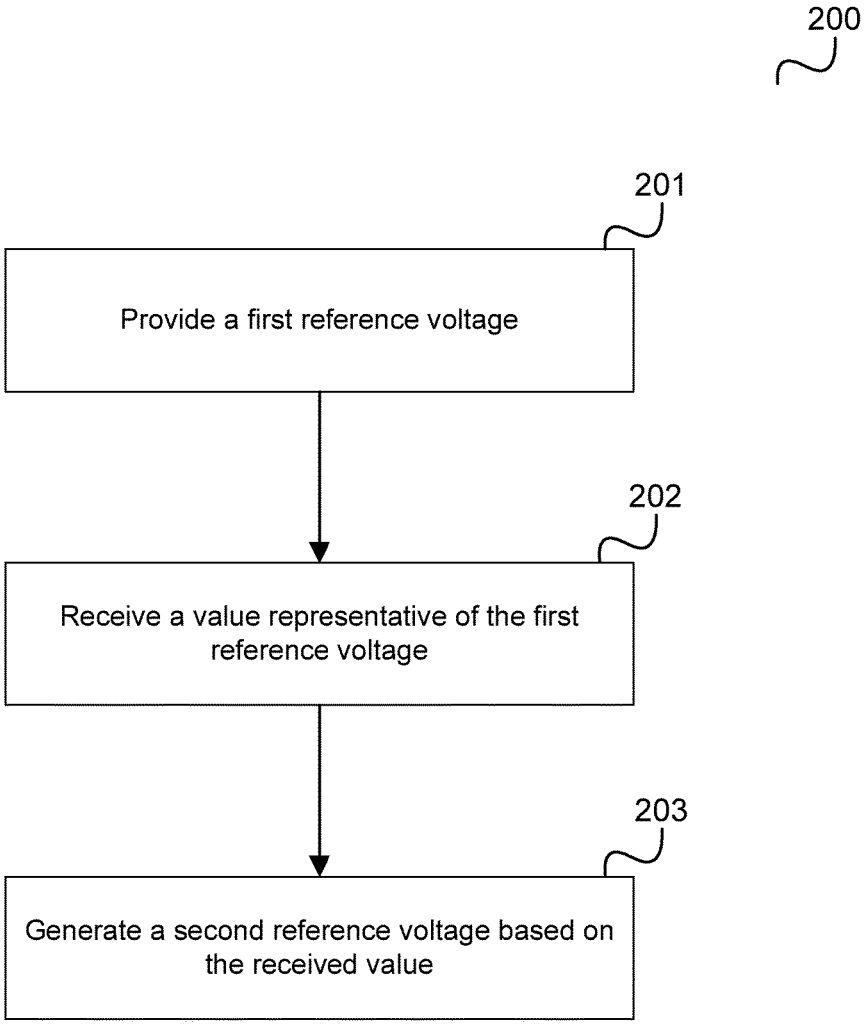
FIG. 2 shows a flow diagram.

The circuit for example carries out a method as illustrated in FIG. 2.

FIG. 2 shows a flow diagram 200.

The flow diagram 200 illustrates a method for providing a reference voltage.

In 201, a first reference voltage is provided.

In 202, a value representative of the first reference voltage is received.

In 203, a second reference voltage is generated based on the received value.

It should be noted that embodiments described in context with the circuit 100 are analogously valid for the method illustrated in FIG. 2 and vice versa.

In the following, embodiments are described in more detail.

Figure 3:
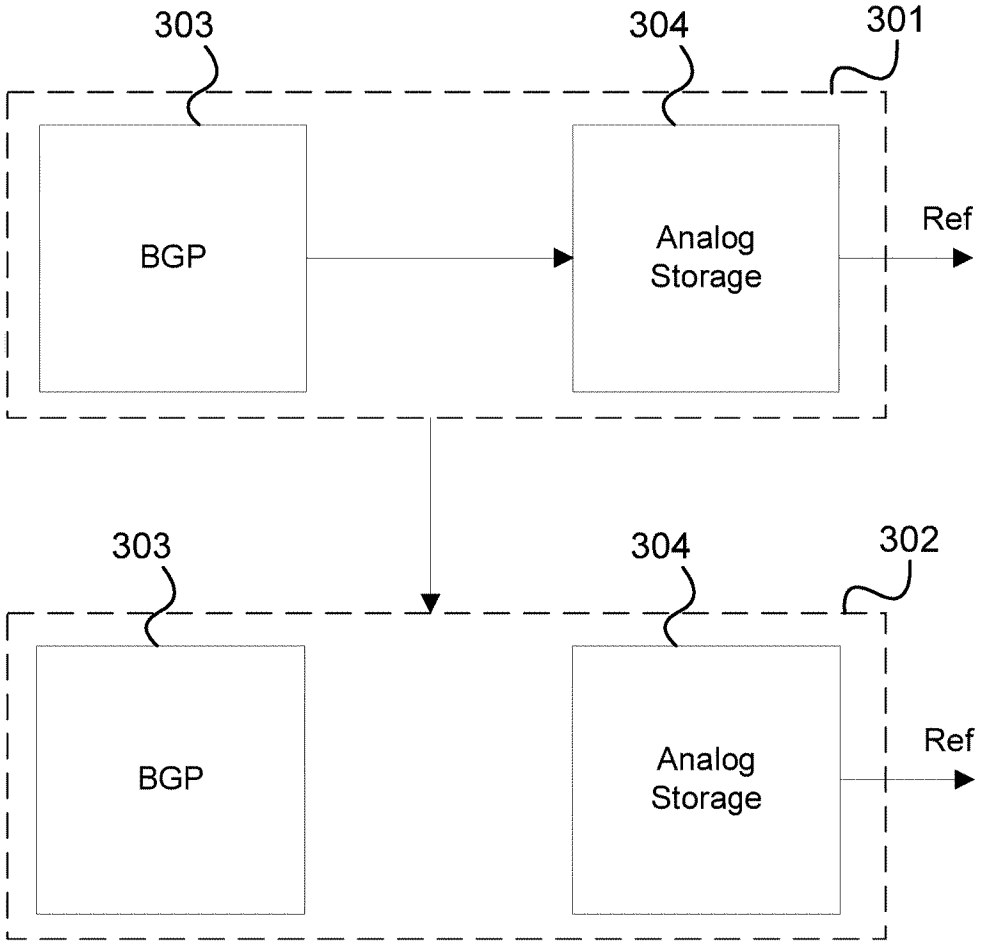
FIG. 3 illustrates the concept of storing a reference voltage provided by a BGP reference voltage generator for usage for reference voltage generation when the BGP reference voltage generator is switched off.

FIG. 3 illustrates the concept of storing a reference voltage provided by a BGP reference voltage generator for usage for reference voltage generation when the BGP reference voltage generator is switched off.

In 301, a BGP reference voltage generator 303 provides a reference voltage (or generally a value representative of the reference voltage) which is stored in an analog storage 304 (e.g. a buffer) and output by the analog storage as voltage reference.

In 302, the BGP reference voltage generator 303 does not provide the reference voltage anymore. For example, it is switched off to reduce the required current. Still, the analog storage 304 outputs a voltage reference based on the stored information (e.g. the stored value representative of the reference voltage). In other words, the stored information is read from the storage to provide the reference voltage.

It should be noted that there may be difficulties in realizing of the analog storage 304 depending on the application. For example, due to a high leakage a simple sample and hold may not be suitable.

In the following, an example is described in which information about the first reference voltage provided by a BPG reference voltage generator, specifically a value representative of the first reference voltage in the form of a control value for the second reference voltage generating circuit, is digitally stored.

Figure 4:
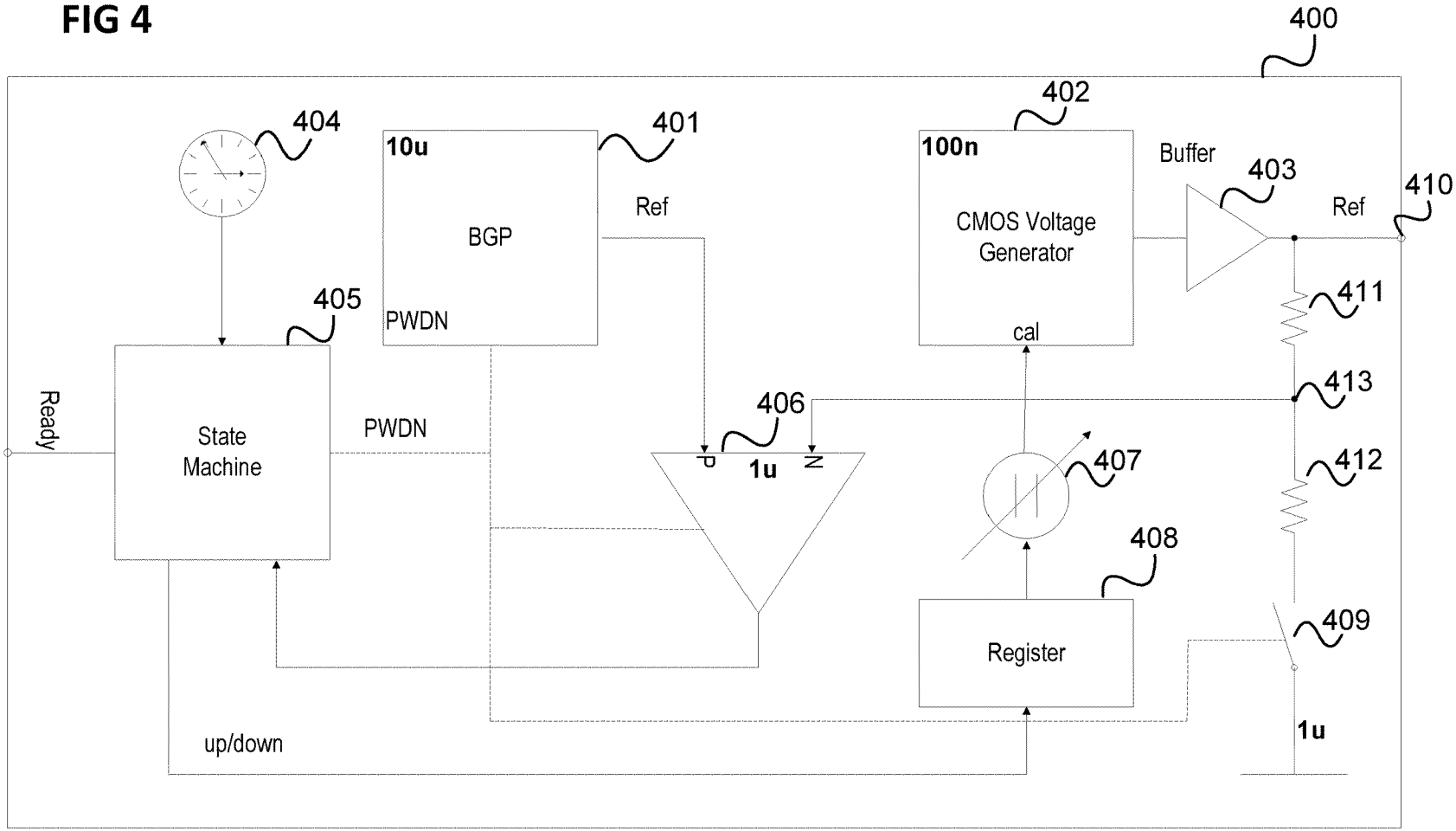
FIG. 4 shows a circuit according to an embodiment.

FIG. 4 shows a circuit 400 according to an embodiment.

The circuit 400 comprises a BGP voltage generator 401, a CMOS voltage generator 402, a buffer 403, a clock generator 404, a state machine 405, a comparator 406, a controllable voltage source 407 and a register 408.

The BGP voltage generator 401 generates a reference voltage, wherein information about this reference voltage is stored for the CMOS voltage generator 402. The CMOS voltage generator 401 gets trimmed in a way that the BGP reference voltage and the CMOS voltage generator output voltage have a predetermined relation (e.g. are the same or have a certain ratio e.g. given by a voltage divider as illustrated in FIG. 4).

Specifically, when the BGP voltage generator 401 is not powered down (i.e. switched off) i.e. a power down signal PWDN is not active, the BGP voltage generator 401 generates a voltage which is supplied to a first input of the comparator 406.

The signal PWDN being not active controls a switch 409 to be closed which connects the output of the buffer 403 to ground via a voltage divider comprising a first resistor 411 and a second resistor 412. The second input of the comparator 406 is connected to the middle point 413 of the voltage divider such that a certain fraction (defined by the values of the resistors 411, 412) of the output of the CMOS voltage generator 402, which is buffered by buffer 403, is fed back to comparator 406.

Thus, the comparator 406 compares the BGP voltage generator output with the fraction of the CMOS voltage generator output. When these two voltages are not equal, the state machine 405, based on the output of the comparator 406, increases or decreases, depending on whether the BPG voltage generator output voltage is higher than the fraction of the CMOS voltage generator output voltage or vice versa, a voltage control value stored digitally in the register 408 which controls the voltage source 407 whose output voltage controls the CMOS voltage generator 402. Thus, the output voltage of the CMOS voltage generator 402 which forms the voltage output by the circuit 400 via a voltage output 410, is controlled such that it has a value with a certain ratio to the BGP voltage generator output voltage (wherein the ratio is defined by the values of resistors 411, 412).

The state machine 405 operates based on a clock signal provided by clock generator 404, such that the voltage control value is (possibly, depending on the output of the comparator) updated each clock cycle. The state machine 405 and the register 408 can be seen as a digital controller of the output voltage of the circuit 400.

When the power down signal PWDN is active, i.e. when the BGP voltage generator 401 is switched off, state machine 405 and comparator 406 are also switched off and the switch 409 is opened. The voltage control value in register 408 is kept the same such that the output voltage of the circuit 400 stays the same when the BGP voltage generator 401 is switched off.

It should be noted that typically a minor systematic error (e.g. due to the step width of trimming, i.e. the coarseness of the processing of the comparator output value) remains. For attenuating various negative influences the calibration (i.e. the control of the output voltage based on the BGP output voltage) is for example triggered periodically.

In the following, an implementation example is described in more detail.

Figure 5:
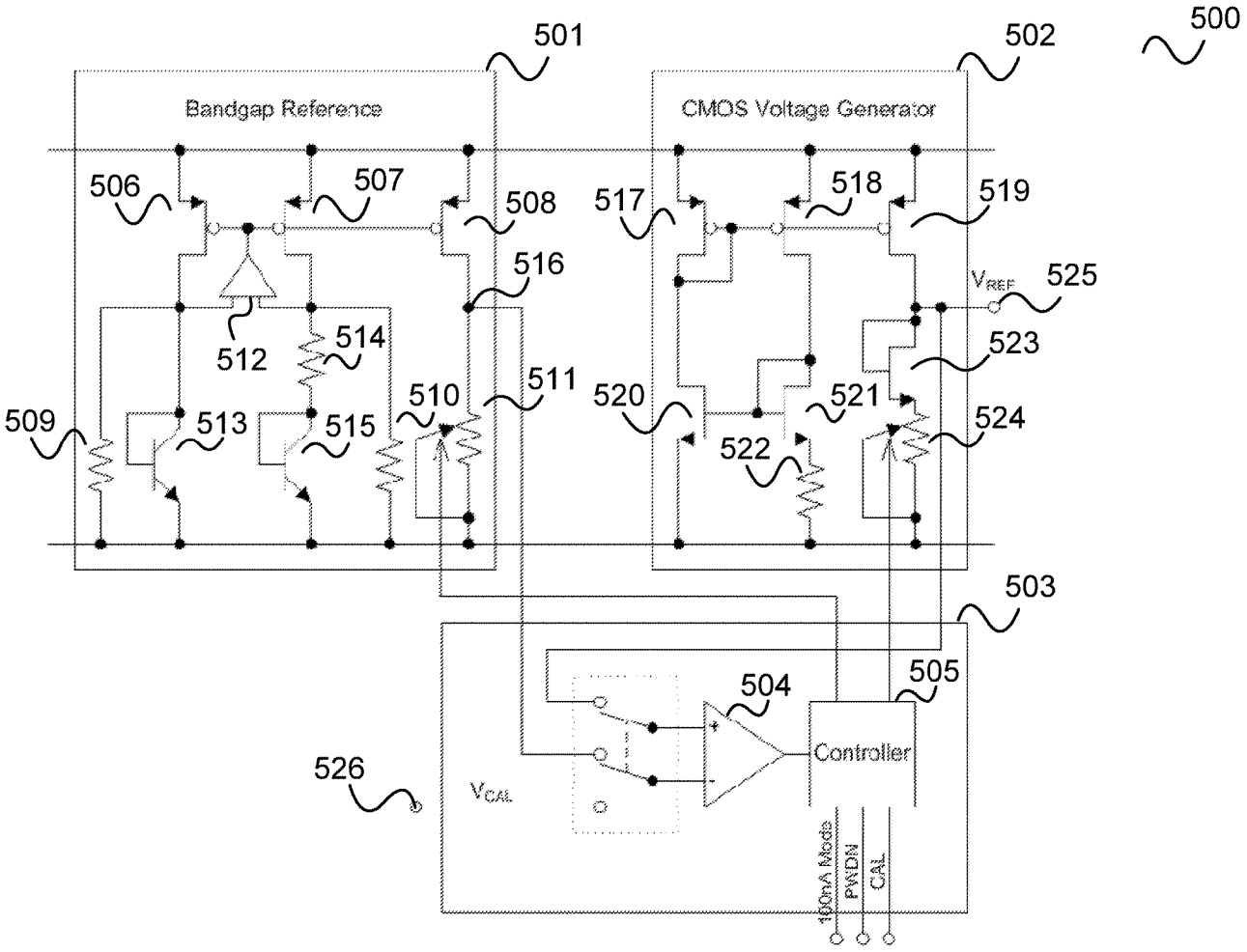
FIG. 5 shows a circuit.

FIG. 5 shows a circuit 500.

The circuit 500 comprises a BGP voltage generator 501, a CMOS voltage generator 502 and a controller part 503.

Similarly to the circuit 400, the controller part 503 comprises a comparator 504 which receives an output voltage from the BGP voltage generator 501 and an output voltage of the CMOS voltage generator 502 and provides it to a digital controller 505 which provides, in this example, a control signal to the BGP voltage generator 501 and a control signal to the CMOS voltage generator 502 to control the output voltages of the BGP voltage generator 501 and the CMOS voltage generator 502 to be the same and stores a value representing the control signal.

The digital controller 505 receives a power down signal PWDN similarly to the power down signal of FIG. 4. Further, in this example, a current saving mode may be activated by a 100 nA mode signal in which the current consumption is limited to 100 nA (cf. the current consumption values indicated in FIG. 4: 100 nA+10 uA+1 uA+1 uA).

The digital controller 505 further has a calibration input (e.g. for tuning) and the digital controller part 503 further has a reference terminal 526 (which may be connected to the comparator 504, which may for example also be used for tuning, e.g. with respect to the accuracy of the BGP voltage generator which is for example about 20 mV).

The BGP voltage generator 501 in this example has a Banba topology: A first p channel transistor 506, a second p channel transistor 507 and a third p channel transistor 508 are connected to a high supply potential (VDD) with their respective source terminals.

The drain terminal of first p channel transistor 506 is connected to a low supply potential (VSS) via first resistor 509. The drain terminal of second p channel transistor 507 is connected to the low supply potential via a second resistor 510. The control terminals of the p channel transistors 506, 507, 508 are connected the output of a comparator 512 whose first input is connected to the drain terminal of the first p channel transistor 506 and whose second input is connected to the drain terminal of the second p channel transistor 507.

The first input of the comparator 512 is further connected to the low supply potential via a first bipolar transistor 513, whose base is connected to its collector, and the second input of the comparator 512 is further connected to the low supply potential via a third resistor 514 and a second bipolar transistor 515, whose base is connected to its collector.

The drain terminal of the third p channel transistor 508, which is connected to the output 516 of the BGP voltage generator 501, i.e. the output wherein the BGP voltage generator 501 outputs the generated voltage, is connected to the low supply potential via a first controllable resistor 511 which is controlled by the control signal provided by the controller 505 to the BGP voltage generator 501.

The CMOS voltage generator 502 comprises a fourth p channel transistor 517, a fifth p channel transistor 518 and a sixth p channel transistor 519 whose source terminals are connected to the high supply potential and whose gates are connected to the drain terminal of the fourth p channel transistor 517.

The drain terminal of the fourth p channel transistor 517 is connected to the drain of a first n channel transistor 520 whose source is connected to the low supply potential and whose gate is connected to the drain of the fifth p channel transistor 518.

The source terminal of the fifth p channel transistor 518 is connected to the drain of a second n channel transistor 521 whose source is connected to the low supply potential via a fourth resistor 522 and whose gate is connected to its drain.

The drain terminal of the sixth p channel transistor 519 is connected to the drain of a third n channel transistor 523 whose source is connected to the low supply potential via a second controllable resistor 524 and whose gate is connected to its drain. The second controllable resistor 524 is controlled by the control signal provided by the controller 505 to the CMOS voltage generator 502.

The drain terminal of the sixth p channel transistor 519 further is connected to the output 525 of the CMOS voltage generator 502, i.e. the output wherein the CMOS voltage generator 502 outputs the generated voltage.

Figure 6:
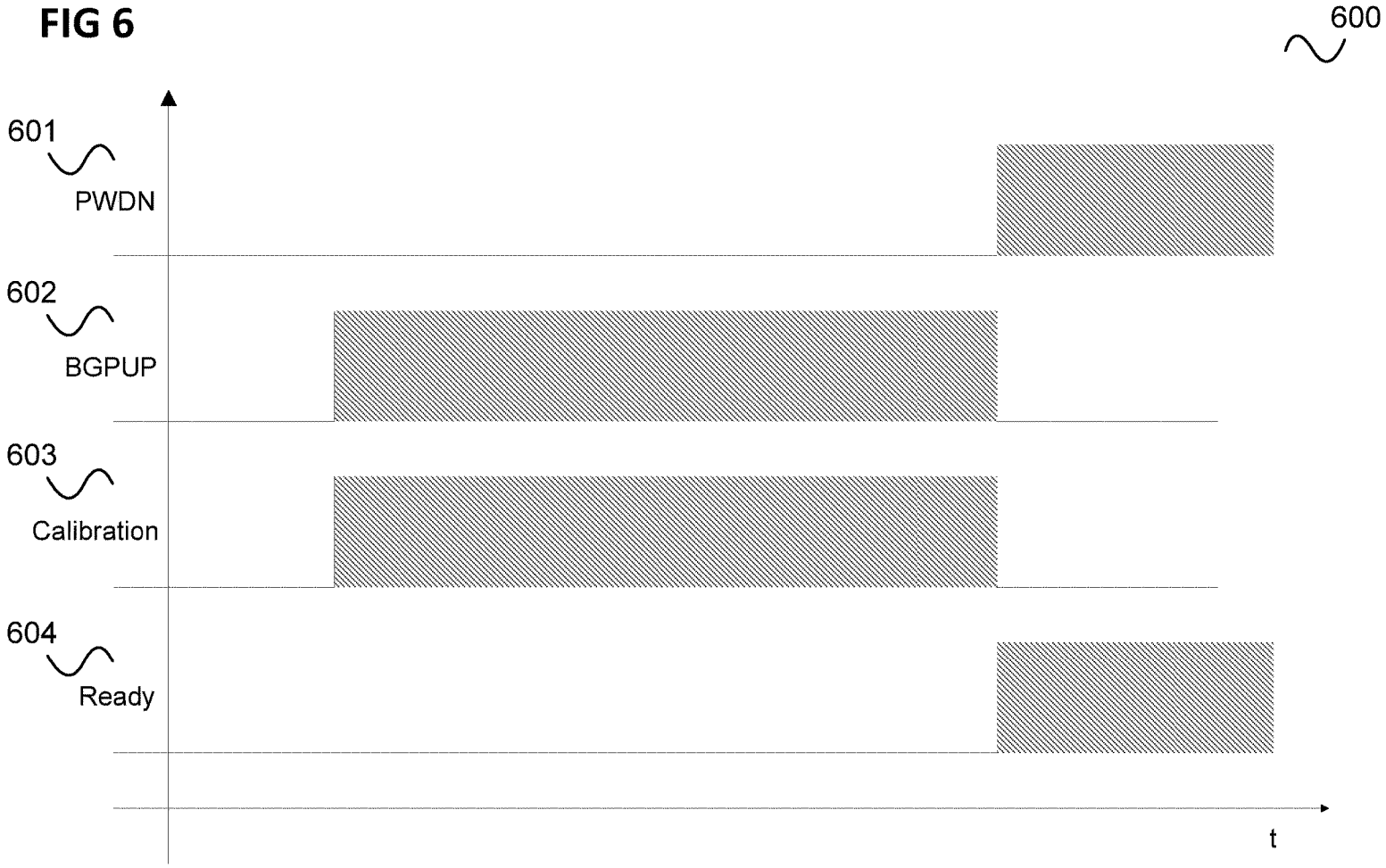
FIG. 6 shows a state diagram for the circuit of FIG. 5.

FIG. 6 shows a state diagram 600 for the circuit 500.

In the state diagram 600, time increases from left to right. For the shown signals and states, the higher level means active while the lower level means inactive.

A first graph 601 shows the power down (PWDN) signal, a second graph 602 shows the state of the BGP (switched on/powered up: active and switched on/powered off: inactive).

A third graph 603 shows the state of the calibration, i.e. whether the control of the output voltages based on the comparison of the output voltages by the comparator 504 is currently active.

A fourth graph 604 shows a ready state, i.e. indicates, when active, that the output voltage of the CMOS voltage generator 502 is being controlled according to the result of the calibration based on the output voltage of the BGP voltage generator 501.

The BGP voltage generator 501 itself can be calibrated on a tester. The comparator 504 may also be used for the BGP voltage generator calibration (in addition to the calibration of the control value, i.e. the determination of the control value for which a representation is stored for voltage control when the BGP voltage generator 501 is powered down). For this, the offset of the comparator 504 is compensated. For example, when the BGP voltage generator 501 provides the voltage reference the offset of the comparator is included after calibration but this is compensated when the information about the control value (i.e. the representation of the control value) is stored.

Figure 7:
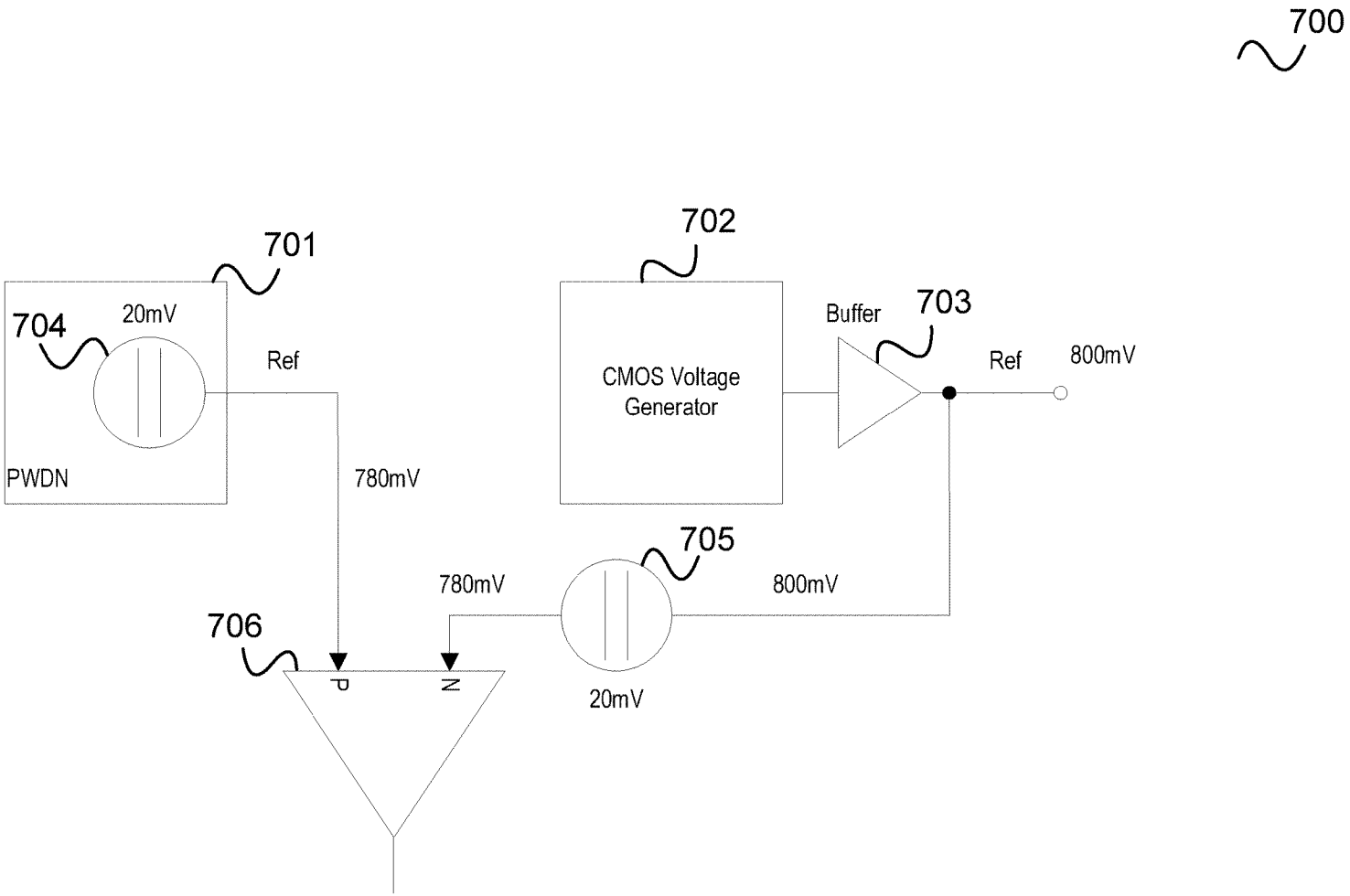
FIG. 7 illustrates an offset compensation.

FIG. 7 illustrates an offset compensation.

A BGP voltage generator 701, a CMOS voltage generator 702, a buffer 703 and a comparator 706 correspond to the BGP voltage generator 401, the CMOS voltage generator 402, the buffer 403 and the comparator 406, respectively. In this example, the feedback of the CMOS voltage generator output voltage is shown without voltage divider for simplicity.

In this example, there is an offset from the comparator coming from the calibration of the BGP voltage generator 701, represented by a first voltage source 704.

The first reference voltage is therefore at 780 mV after calibration if comparator 706 is used (with external calibration voltage of 800 mV and comparator offset of 20 mV). Thus, the comparator receives a voltage of 780 mV instead of 800 mV from the BGP voltage generator 701. This is taken into account by a corresponding offset at the second input of the comparator 706, represented by a second voltage source 705 coupled between the second input of the comparator 706 and the output of the buffer 703. The voltage source 704 provides a voltage of 20 mV such that in the end, the output voltage of the buffer 703 is controlled to be 800 mV.

With regard to temperature behavior, it should be noted that CMOS voltage generators typically have a very good temperature behavior compared to their absolute accuracy. The comparator offset may be eliminated as mentioned above. The temperature behavior of the comparator, if not compensated, may limit the size of the comparator. Further, the BGP may be dependent on temperature. Accordingly, according to one embodiment, adjustments are made for the BGP voltage generator (and possibly also the CMOS voltage generator) based on the temperature.

With respect to current consumption, it should be noted that the current consumption of embodiments such as described with reference to FIGS. 4 and 5 is similar to a typical BGP voltage generator when the BGP voltage generator is on. However, when the BGP voltage generator is in power down mode (i.e. off), only the CMOS voltage generator is on. Thus, reference voltage generation circuits may be implemented that operate with a current consumption below 1 uA (when the BGP voltage generator is powered down).

Regarding voltage operation, 1V is typically a lower supply voltage limit of the BGP voltage generator such as the BGP voltage generator 501 since a pnp bipolar transistor typically needs 800 mV over the whole temperature range. A CMOS voltage generator can also operate with all transistors in sub threshold, so there is no theoretical limit. 600 mV are possible and thinkable over the whole temperature range. Thus, in sleep mode (i.e. BPG generator is powered down), the supply voltage can be reduced to further save energy.

Regarding the switching between lower power (BGP voltage generator off) and high performance (BGP voltage generator on) it should be noted that due to the fact that the CMOS voltage generator can be seen to work as a buffer the switching between these modes causes no steps in the reference voltage.

It should further be noted that the energy consumption of the state machine 405 can kept very low by operating it at a low clock frequency (e.g. <<1 MHz). The state machine 405 makes a decision based on the comparator output whether to increase or decrease the control value (e.g. by 1) stored in the register 408. Thus, in equilibrium, the last bit of the control value may be toggling. This can be avoided by implementing a hysteresis in the comparator in the range of the last bit of the calibration. Based on the control value, the CMOS voltage generator can be controlled using a resistor network using a thermometer code or by a redundant binary weighted network.

Figure 8:
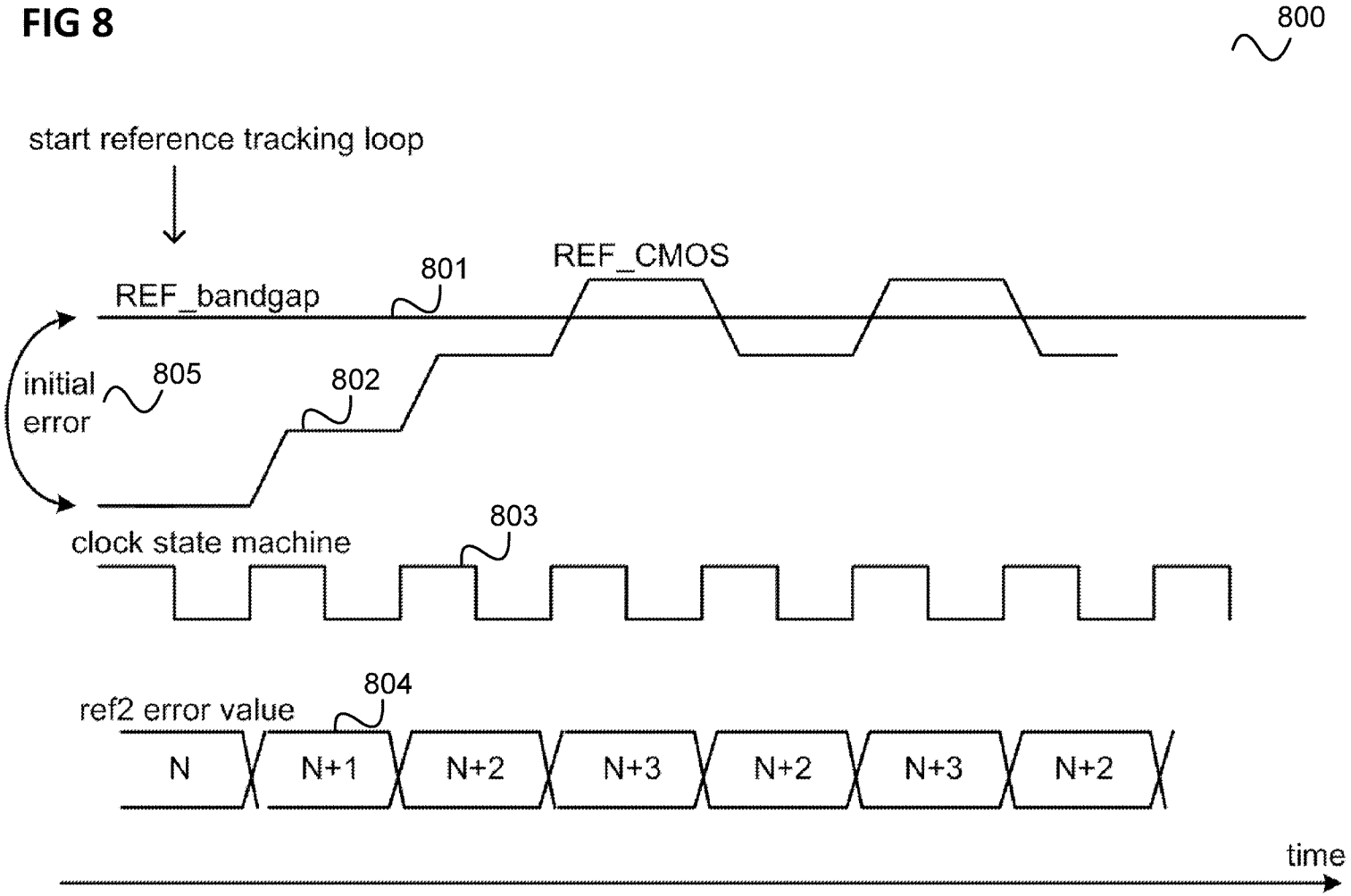
FIG. 8 shows a signal diagram illustrating an example of a control of the CMOS voltage generator to provide an output voltage equal to the BGP voltage generator output voltage.

FIG. 8 shows a signal diagram 800 illustrating an example of a control of the CMOS voltage generator to provide an output voltage equal to the BGP voltage generator output voltage.

In FIG. 8, time increases from left to right and the level of the various signals increases from bottom to top.

A first graph 801 shows the (constant) output voltage of the BGP voltage generator e.g. corresponding to BGP voltage generator 401.

A second graph 802 shows the output voltage of the CMOS voltage generator e.g. corresponding to CMOS voltage generator 402 (without the voltage divider in the circuit 400 or with the resistance of the first resistor 411 being zero such that the output of the CMOS voltage generator is controlled to be equal to the BGP voltage generator output voltage).

A third graph 803 illustrates the clock, e.g. provided by the clock generator 404 to the state machine 405.

A fourth graph 804 illustrates the control value over time.

It is assumed that the control value is initially N which corresponds to a certain initial error 805 between the CMOS voltage generator output voltage and the BGP voltage generator output voltage. After three clock cycles, the CMOS voltage generator output voltage has reached (and exceeded) the BGP voltage generator output voltage (corresponding to a control value of N+3) and the control value starts to toggle between N+3 and N+2.

It should be noted that reference voltage circuits such as described above can typically be easily simulated. However, temperature behavior is typically hard to simulate for BGP and CMOS voltage generators, due to the fact that temperature behavior is typically not included in transistor models.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A circuit, comprising:

a first reference voltage generating circuit comprising an output to provide a first reference voltage;

a second reference voltage generating circuit comprising an input receiving a value representative of the first reference voltage and a memory configured to store a value representative of the first reference voltage or a value derived from the value representative of the first reference voltage, the second reference voltage generating circuit being configured to generate a second reference voltage based on the value representative of the first reference voltage or a value derived from the value representative of the first reference voltage, wherein the second reference voltage generating circuit is configured to generate the second reference voltage in a state of the circuit when the first reference voltage generating circuit is switched off.

2. The circuit according to claim 1, further comprising an error determination circuit configured to provide an error signal based on the first reference voltage and the second reference voltage, wherein the second reference voltage generating circuit is configured to provide the second reference voltage based on the error signal.

3. The circuit according to claim 1, comprising a controlling circuit configured to determine the value representative of the first reference voltage based on the error signal.

4. The circuit according to claim 1, wherein the first reference voltage generating circuit generates the first reference voltage with a higher accuracy than the accuracy the second reference voltage generating circuit is capable of generating without an input from the first reference voltage generating circuit.

5. The circuit according to claim 1, wherein the first reference voltage generating circuit is a bandgap voltage reference generator.

6. The circuit according to claim 1, wherein the value representative of the first reference voltage is a control value for the second reference voltage generating circuit for controlling the second reference voltage generating circuit to output a reference voltage with a predetermined relation to the first reference voltage.

7. The circuit according to claim 1, wherein the value representative of the first reference voltage or a value depending from the value representative of the first reference voltage is a digital value.

8. The circuit according to claim 1, wherein the second reference voltage generating circuit is a CMOS voltage generator.

9. The circuit according to claim 1, wherein a value representative of the first reference voltage is stored in an analog voltage buffer, and wherein the second reference voltage generating circuit is configured to use the stored value from the analog voltage buffer to generate the second reference voltage.

10. The circuit according to claim 1, wherein a value representative of the first reference voltage is a digital value stored in a register, and wherein the second reference voltage generating circuit is configured to use the stored digital value from the register to generate the second reference voltage.

11. The circuit according to claim 1, wherein the second reference voltage generating circuit is configured to generate the second reference when the first reference voltage generating circuit is switched off, the second reference voltage generating circuit basing the second reference voltage on a value representative of the first reference voltage stored in memory.

12. A method for providing a reference voltage, comprising:

providing a first reference voltage;

receiving a value representative of the first reference voltage;

storing the value representative of the first reference voltage or a value derived from the value representative of the first reference voltage, and generating a second reference voltage based on the stored value while the first reference voltage generating circuit is switched off.

13. A circuit, comprising:

a first reference voltage generating circuit configured to provide a first reference voltage;

a second reference voltage generating circuit configured to provide a second reference voltage and comprising a memory configured to store a value representative of the first reference voltage or a value derived from the value representative of the first reference voltage;

an error determination circuit configured to provide an error signal based on the first reference voltage and the second reference voltage;

wherein the second reference voltage generating circuit is further configured to provide the second reference voltage based on the error signal, and wherein the second reference voltage generating circuit is configured to generate the second reference voltage in a state of the circuit when the first reference voltage generating circuit is switched off.

* * * * *